US009316985B2

(12) United States Patent
Miwa

(10) Patent No.: US 9,316,985 B2
(45) Date of Patent: Apr. 19, 2016

(54) IMAGE FORMING APPARATUS

(71) Applicant: Brother Kogyo Kabushiki Kaisha, Nagoya-shi, Aichi-ken (JP)

(72) Inventor: Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/553,682

(22) Filed: Nov. 25, 2014

(65) Prior Publication Data

US 2015/0147104 A1 May 28, 2015

(30) Foreign Application Priority Data

Nov. 25, 2013 (JP) ..... 2013-243167

(51) Int. Cl.

| | |
|---|---|
| ***G03G 15/00*** | (2006.01) |
| ***G03G 15/20*** | (2006.01) |
| ***B65H 29/70*** | (2006.01) |
| ***B65H 29/22*** | (2006.01) |
| ***B65H 29/12*** | (2006.01) |

(Continued)

(52) U.S. Cl.

CPC ..... *G03G 15/6552* (2013.01); *B65H 29/125* (2013.01); *B65H 29/14* (2013.01); *B65H 29/22* (2013.01); *B65H 29/52* (2013.01); *B65H 29/60* (2013.01); *B65H 29/70* (2013.01); *B65H 2301/5122* (2013.01); *B65H 2301/51214* (2013.01); *B65H 2402/45* (2013.01); *B65H 2402/46* (2013.01); *B65H 2404/1317* (2013.01); *B65H 2404/612* (2013.01); *B65H 2601/11* (2013.01); *B65H 2801/12* (2013.01); *G03G 2215/00679* (2013.01)

(58) Field of Classification Search

CPC ..... G03G 15/00; G03G 15/6552; G03G 2215/00679; G03G 15/20; G03G 15/23; B65H 29/00; B65H 29/70; B65H 29/20; B65H 29/22

USPC ..... 399/381, 405, 406

See application file for complete search history.

(56) References Cited

U.S. PATENT DOCUMENTS 5,258,815 A * 11/1993 Nakagawa ..... G03G 15/2064 162/271
5,265,864 A * 11/1993 Roux et al. ..... 271/186

(Continued)

FOREIGN PATENT DOCUMENTS

JP 61203061 A * 9/1986 ..... B65H 29/22
JP 62012569 A * 1/1987 ..... G03G 15/00

(Continued)

*Primary Examiner* — Nguyen Ha
(74) *Attorney, Agent, or Firm* — Banner & Witcoff, Ltd.

(57) ABSTRACT

An image forming apparatus includes a transfer unit configured to transfer a developing agent image onto a sheet, a fixing unit configured to fix the developing agent image onto the sheet, a discharge tray configured to receive the sheet having the developing agent image thereon, at least one pair of discharge rollers disposed downstream of the fixing unit in a conveying direction and configured to discharge the sheet toward the discharge tray, and at least one pair of conveying rollers disposed at a conveying path extending between the fixing unit and the at least one pair of discharge rollers. The at least one pair of conveying rollers is configured to convey the sheet toward the at least one discharge rollers in the conveying direction and to form the sheet into a corrugated shape having at least one of a ridge portion and a groove portion in a sheet thickness direction.

12 Claims, 9 Drawing Sheets

(51) Int. Cl.

| | |
|---|---|
| ***B65H 29/14*** | (2006.01) |
| ***B65H 29/60*** | (2006.01) |
| ***B65H 29/52*** | (2006.01) |

(56) References Cited

U.S. PATENT DOCUMENTS

| | | | | |
|---|---|---|---|---|
| 7,672,628 | B2 | 3/2010 | Sato | |
| 7,979,020 | B2 | 7/2011 | Tomatsu | |
| 8,315,539 | B2 | 11/2012 | Uehara | |
| 2006/0013628 | A1* | 1/2006 | Shishikura | G03G 15/6573 399/405 |
| 2007/0092322 | A1 | 4/2007 | Tomatsu | |
| 2008/0101830 | A1 | 5/2008 | Sato | |
| 2009/0295061 | A1* | 12/2009 | Honda | B41J 13/0036 271/3.14 |
| 2010/0032895 | A1* | 2/2010 | Sahara | B65H 29/14 271/314 |
| 2010/0078884 | A1 | 4/2010 | Uehara | |
| 2010/0247196 | A1* | 9/2010 | Ichiki | G06G 15/6552 399/381 |
| 2011/0170923 | A1* | 7/2011 | Haruyama | B65H 29/14 399/405 |
| 2013/0038018 | A1 | 2/2013 | Uehara | |
| 2013/0187334 | A1* | 7/2013 | Kimura | B65H 29/70 271/314 |
| 2014/0374987 | A1* | 12/2014 | Uehara et al. | 271/264 |

FOREIGN PATENT DOCUMENTS

| | | | | | |
|---|---|---|---|---|---|
| JP | 06087558 | A | * | 3/1994 | G03G 15/20 |
| JP | 07017655 | A | * | 1/1995 | G03G 15/20 |
| JP | 09086752 | A | * | 3/1997 | B65H 29/20 |
| JP | 09281826 | A | * | 10/1997 | G03G 15/20 |
| JP | H09-281826 | A | | 10/1997 | |
| JP | 09297479 | A | * | 11/1997 | G03G 15/20 |
| JP | 11157718 | A | * | 6/1999 | B65H 29/22 |
| JP | 2001-139207 | A | | 5/2001 | |
| JP | 2007062869 | A | * | 3/2007 | B65H 29/70 |
| JP | 2007-119142 | A | | 5/2007 | |
| JP | 2008-110823 | A | | 5/2008 | |
| JP | 2009-012951 | A | | 1/2009 | |
| JP | 2010-079049 | A | | 4/2010 | |
| JP | 2010132440 | A | * | 6/2010 | B65H 29/22 |
| JP | 2012098448 | A | * | 5/2012 | G03G 15/00 |

* cited by examiner

IMAGE FORMING APPARATUS

CROSS-REFERENCE TO RELATED APPLICATION

This application claims priority from Japanese Patent Application No. 2013-243167, filed on Nov. 25, 2013, which is incorporated herein by reference in its entirety.

TECHNICAL FIELD

Aspects disclosed herein relate to an electrophotographic image forming apparatus.

BACKGROUND

An image forming apparatus includes a pair of conveying rollers that conveys a sheet toward a pair of discharge rollers. The pair of conveying rollers is disposed at a conveying path and between a fixing unit and the pair of discharge rollers. The pair of conveying rollers allows a sheet to be conveyed reliably to the pair of discharge rollers even when the sheet has a relatively small length in a sheet conveying direction.

In a known image forming apparatus, a fixing unit heats a sheet and a developing agent image transferred onto the sheet to fix the developing agent image onto the sheet. At this time, the heated sheet may be curled depending on the type of sheet, the ambient temperature, and the humidity, which may cause a sheet conveying failure such as a sheet jam.

SUMMARY

Aspects of the disclosure relate to an image forming apparatus that may prevent or reduce an occurrence of a sheet conveying failure even when a sheet heated by a fixing unit is curled.

Aspects of the disclosure provide an image forming apparatus comprising a transfer unit configured to transfer a developing agent image onto a sheet, a fixing unit comprising a heating member, which is configured to thermally fix the developing agent image onto the sheet, and a pressing member, which is configured to press the sheet against the heating member, a discharge tray configured to receive the sheet having the developing agent image fixed thereon, at least one pair of discharge rollers disposed downstream of the fixing unit in a conveying direction and configured to discharge the sheet toward the discharge tray, and at least one pair of conveying rollers disposed at a conveying path extending between the fixing unit and the at least one pair of discharge rollers. The at least one pair of conveying rollers is configured to convey the sheet toward the at least one discharge rollers in the conveying direction and to form the sheet into a corrugated shape having at least one of a ridge portion and a groove portion in a sheet thickness direction.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
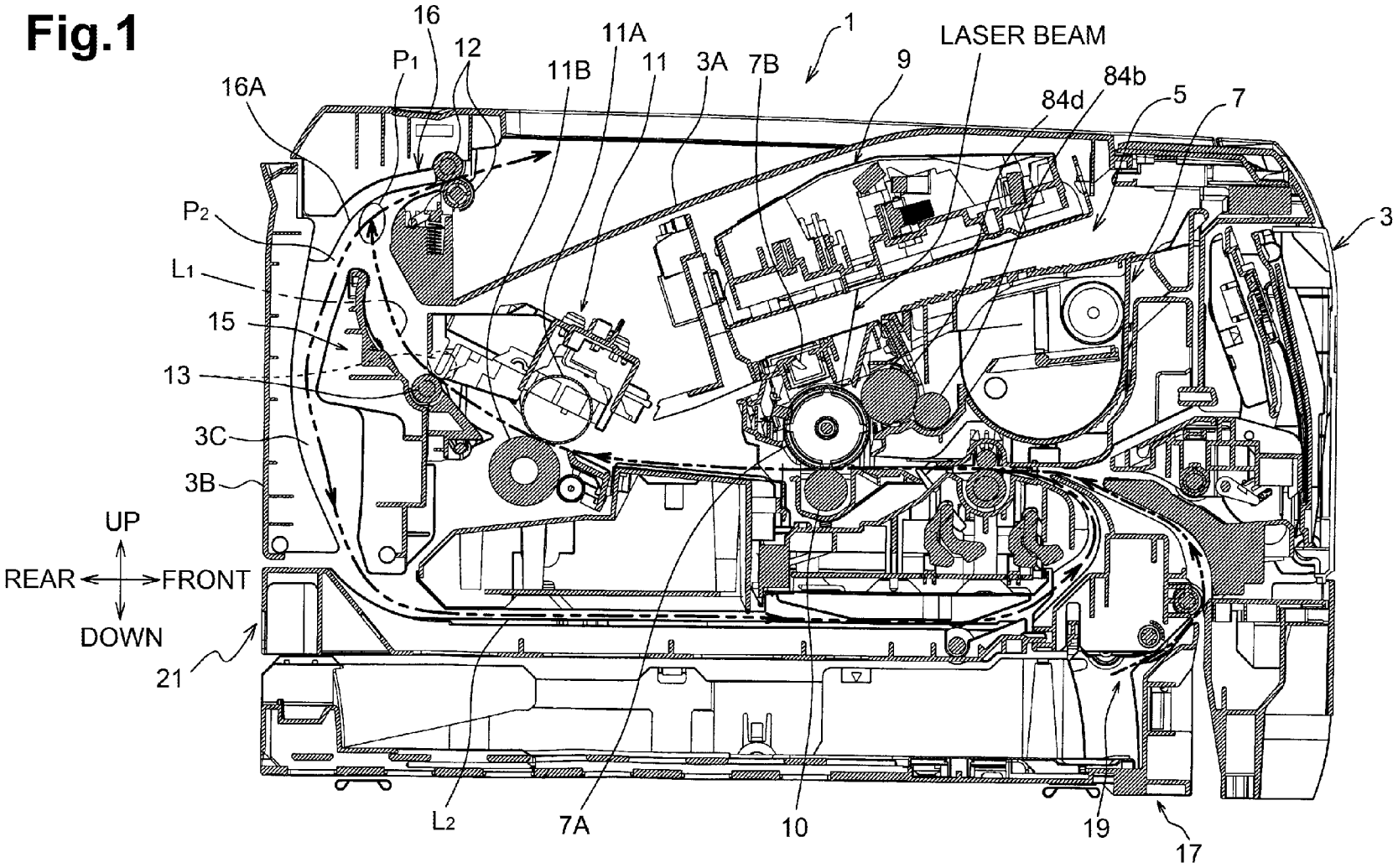
FIG. 1 is a central cross-sectional view depicting an image forming apparatus in a first illustrative embodiment according to one or more aspects of the disclosure.

Illustrative embodiments according to one or more aspects will be described below with reference to the accompanying drawings. The illustrative embodiments described below are merely examples. Various changes, arrangements and modifications may be applied therein without departing from the spirit and scope of the disclosure.

In the illustrative embodiments, one or more aspects of the disclosure are applied to a monochrome image forming apparatus. Directional arrows are appended in the drawings for easier understanding of relationships among the drawings. The disclosure is not limited to the directions defined in the drawings.

(First Illustrative Embodiment)

1. Overview of Image Forming Apparatus

As depicted in FIG. 1, an image forming apparatus 1 includes an image forming unit 5 positioned in a housing 3 thereof. The image forming unit 5 forms an image onto a sheet, e.g., a recording sheet. The image forming unit 5 is an electrophotographic image forming unit and includes, for example, a process cartridge 7, an exposing unit 9 and a fixing unit 11.

The process cartridge 7 includes a photosensitive drum 7A and a charger 7B. The photosensitive drum 7A carries a developing agent image thereon. The charger 7B charges a surface of the photosensitive drum 7A. The exposing unit 9 forms an electrostatic latent image on the charged surface of the photosensitive drum 7A.

A transfer unit 10 is disposed facing the photosensitive drum 7A. The transfer unit 10 transfers a developing agent image onto a sheet from the photosensitive drum 7A. The fixing unit 11 includes a heating member 11A and a pressing member 11B.

The heating member 11A applies heat to a sheet having a developing agent image to fix the developing agent image onto the sheet. The pressing member 11B presses the sheet against the heating member 11A. The heating member 11A further applies conveying force to the sheet while rotating in contact with the sheet. The pressing member 11B rotates following the movement of the sheet.

A plurality of discharge roller pairs 12 is disposed downstream of the fixing unit 11 in a conveying direction of a sheet. A discharge tray 3A is disposed at the top of the housing 3. After image formation on a sheet is completed, the sheet is discharged onto the discharge tray 3A by the discharge roller pairs 12. Detailed configuration of the discharge roller pairs 12 will be described later.

A conveying path L1 extends between the fixing unit 11 and the plurality of discharge roller pairs 12. A plurality of conveying roller pairs 13 is disposed at a particular position in the conveying path L1. The plurality of conveying roller pairs 13 conveys a sheet toward the plurality of discharge roller pairs 12. Detailed configuration of the conveying roller pairs 13 will be described later.

The plurality of discharge roller pairs 12 is disposed above the fixing unit 11 and is spaced apart from the fixing unit 11. Thus, the conveying path L1 has a U-shape to cause an approximately 180-degree change in the conveying direction of a sheet discharged from the fixing unit 11. The plurality of conveying roller pairs 13 is disposed closer to the fixing unit 11 than an inflection point P1 of the conveying path L1. In other words, the plurality of conveying rollers 13 is disposed downstream of the fixing unit 11 and upstream of the inflection point P1 in the conveying direction.

The inflection point P1 of the conveying path L1 is a point at which the conveying direction of a sheet being conveyed is greatly changed. For example, in the first illustrative embodiment, the conveying direction of a sheet discharged from the fixing unit 11 is a rearward direction at first. The conveying direction of the sheet discharged toward the rear from the fixing unit 11 is then changed gradually to an upward direction by a first guide member 15.

The conveying direction of the sheet that is being conveyed upward along the first guide member 15 is further changed to a frontward direction by a second guide member 16. In the first illustrative embodiment, a point at which the conveying direction is changed from the rearward direction to the frontward direction refers to the inflection point P1 of the conveying path L1. The inflection point P1 of the conveying path L1 is defined between the first guide member 15 and the second guide member 16.

A feeder mechanism 19 is disposed upstream of the photosensitive drum 7A in the conveying direction. The feeder mechanism 19 feeds one or more sheets placed on a feed tray 17, one by one, toward the image forming unit 5. The feed tray 17 supports one or more sheets to be conveyed to the image forming unit 5.

The feed tray 17 is configured to be attached to and detached from a main body of the image forming apparatus 1. The main body includes, for example, a portion that is not detachable or attachable or a portion that is not replaceable by a user, e.g., the housing 3 and a pair of main frames (not depicted). The pair of main frames is a pair of reinforcing members having a generally plate shape. The main frames are disposed at both end portions of the main body, respectively, such that the process cartridge 7 is interposed therebetween.

The plurality of discharge roller pairs 12 is configured to switch back a sheet being conveyed as well as to discharge a sheet onto the discharge tray 3A. Switching back a sheet includes reversing the conveying direction to cause a sheet being conveyed to move toward a return path L2. The return path L2 is another conveying path for conveying a sheet having an image on its first side toward an entrance of the image forming unit 5, i.e., toward the transfer unit 10.

The return path L2 has an entrance P2 that is closer to the discharge roller pairs 12 than the conveying roller pairs 13 in the conveying path L1. In other words, the conveying path L1 is branched into the return path L2 at a position downstream of the conveying roller pairs 13 and upstream of the discharge roller pairs 12 in the conveying direction. In the first illustrative embodiment, the entrance P2 is defined between an end of the first guide member 15 and an end of the second guide member 16.

The return path L2 is defined by a rear cover 3B and a return unit 21. The rear cover 3B is configured to close an opening 3C defined in a rear portion of the housing 3. The rear cover 3B is further configured to move between a position at which the rear cover 3B closes the opening 3C and a position at which the rear cover 3B exposes the opening 3C. The rear cover 3B defines a vertically-extending portion of the return path L2 that extends along the vertical direction between the entrance P2 and the return unit 21.

The return unit 21 defines a portion of the return path L2 that extends along the horizontal direction between a lower end of the vertically-extending portion of the return path L2 and the entrance of the image forming unit 5. In order to form images on both sides of a sheet, an image is formed on a first side of the sheet at first. The sheet having an image on the first side is then conveyed to the discharge roller pairs 12. When the sheet reaches the discharge roller pairs 12, the sheet is conveyed in the reverse direction by the discharge roller pairs 12 and thus is conveyed to the return unit 21. The sheet is then further conveyed to the image forming unit 5 from the return unit 21. In this state, a second side of the sheet faces the surface of the photosensitive drum 7A, whereby an image is formed on the second side of the sheet.

Figure 2:
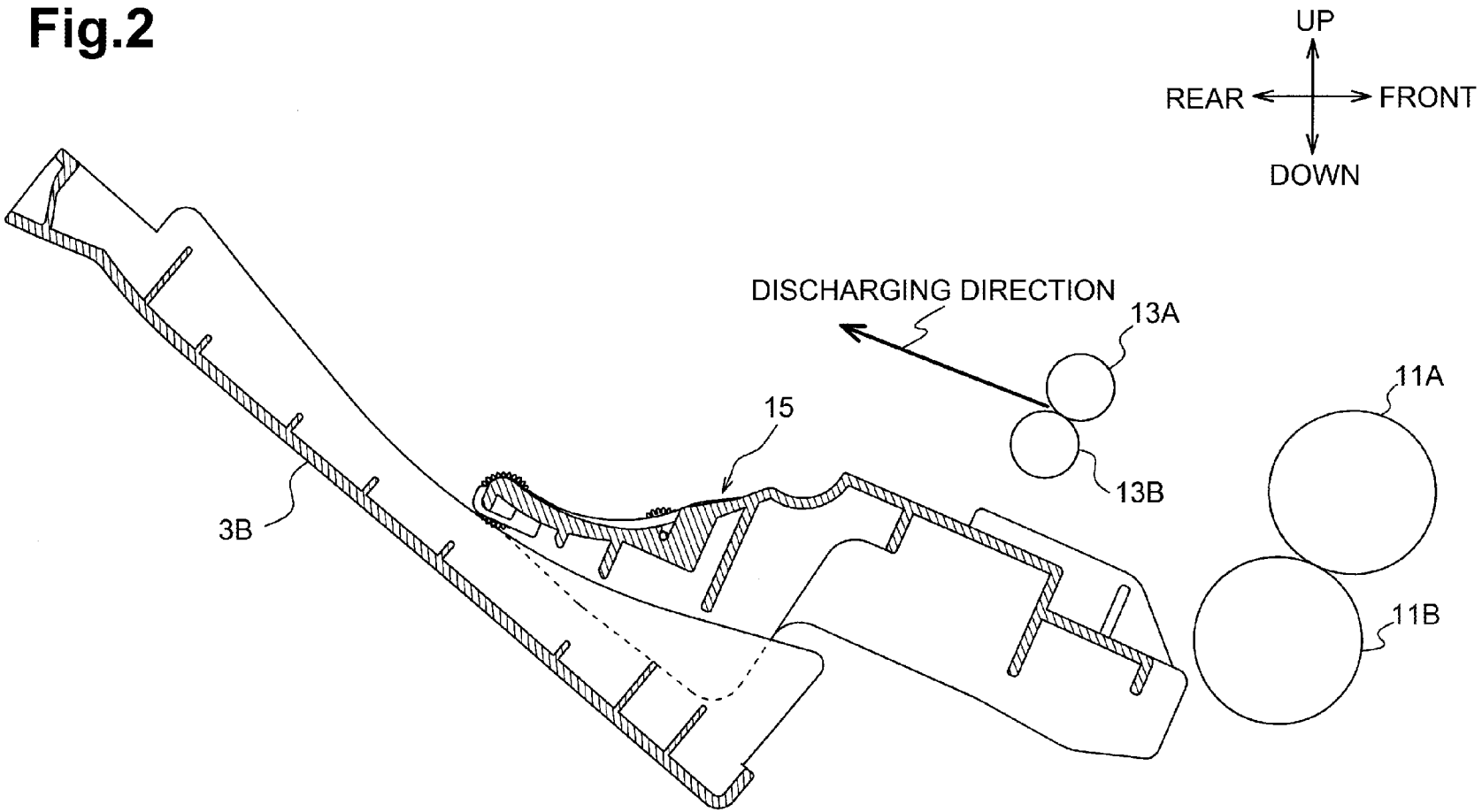
FIG. 2 is a cross-sectional view depicting a rear cover and a first guide member, both of which are located in a position to allow a sheet to be discharged substantially straightly in the first illustrative embodiment according to one or more aspects of the disclosure.

In the first illustrative embodiment, the first guide member 15 is configured to move between a closed position at which the first guide member 15 defines the conveying path L1 (refer to FIG. 1) and an open position at which the first guide member 15 exposes the conveying path L1 and allows a sheet discharged from the fixing unit 11 to be discharged to an exterior of the main body in a discharging direction (refer to FIG. 2).

That is, the rear cover 3B and the first guide member 15 are both pivotable on their lower end portions with respect to the main body. As depicted in FIG. 2, in a state where the rear cover 3B and the first guide member 15 are open, the sheet conveyed from the fixing unit 11 is allowed to be discharged substantially straightly to the rear of the image forming apparatus 1. Further, in this state, the rear cover 3B and the first guide member 15 serve as another discharge tray.

Figure 3:
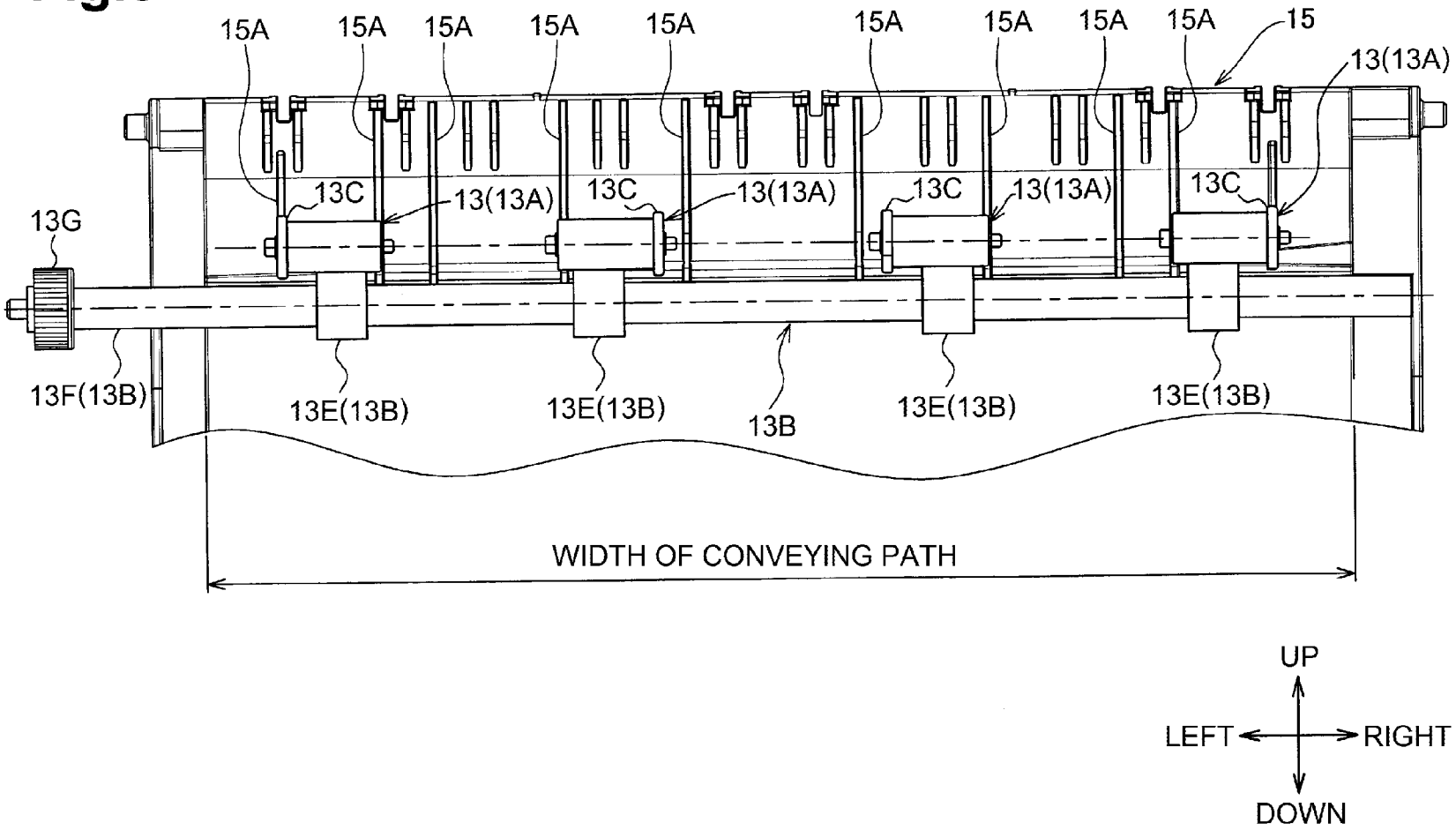
FIG. 3 is a front view depicting the first guide member and conveying roller pairs in the first illustrative embodiment according to one or more aspects of the disclosure.
Figure 4:
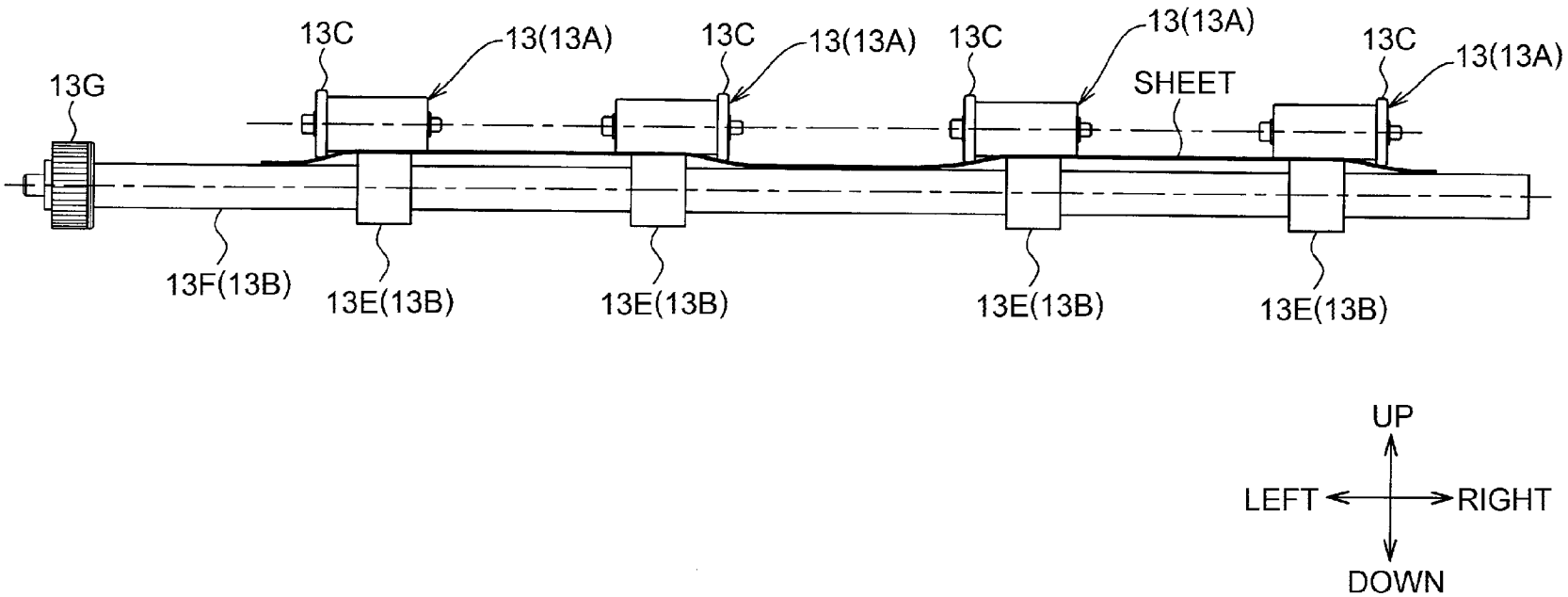
FIG. 4 is a front view depicting the conveying roller pairs in the first illustrative embodiment according to one or more aspects of the disclosure.

2. Configuration of Conveying Roller Pairs and Discharge Roller Pairs 2.1 Configuration of Conveying Roller Pairs and Their Surrounding Portions As depicted in FIG. 3, the conveying roller pairs 13 are disposed facing the first guide member 15 in the conveying path L1. As depicted in FIG. 4, the conveying roller pairs 13 include first conveying rollers 13A and rollers 13E of a second conveying roller 13B, and more specifically, each of the conveying roller pairs 13 includes one of the first conveying rollers 13A and one of the rollers 13E of the second conveying roller 13B.

The first conveying rollers 13A are disposed such that, when a sheet passes the conveying roller pairs 13, the first conveying rollers 13A contact a first side of the sheet. The second conveying roller 13B is disposed such that, when a sheet passes the conveying roller pairs 13, the second conveying roller 13B contacts a second side of the sheet. The "first side of the sheet" refers to the side of a sheet with which the heating member 11A of the fixing unit 11 comes into contact. The "second side of the sheet" refers to the side of a sheet with which the pressing member 11B of the fixing unit 11 comes into contact.

That is, the first conveying rollers 13A are located on the same side as the heating member 11A with respect to a sheet being conveyed. The second conveying roller 13B is located on the same side as the pressing member 11B with respect to a sheet being conveyed. In other words, the first conveying rollers 13A and the heating member 11A are located on the same side of the conveying path L1, and the second conveying roller 13B and the pressing member 11B are located on the same side of the conveying path L1.

The first conveying rollers 13A rotate on their respective central axes that extend in a direction parallel to a sheet width direction. In the first illustrative embodiment, the first conveying rollers 13A each have a diameter of, for example, 10 mm. The sheet width direction refers to a direction perpendicular to a sheet thickness direction and the conveying direction.

Among the first conveying rollers 13A, at least two first conveying rollers 13A disposed at respective positions corresponding to end portions of a sheet in the sheet width direction include protrusions 13C, respectively. Each protrusion 13C comes into contact with a corresponding end portion of a sheet being conveyed to form a sheet into a corrugated shape. In the first illustrative embodiment, the protrusions 13C each have a diameter of, for example, 13.5 mm.

Forming a sheet into a corrugated shape refers to forming at least one of a groove portion and a ridge portion in a sheet in the sheet thickness direction, as depicted in FIG. 4. In the first illustrative embodiment, a distance in the axial direction between a particular roller 13E of the second conveying roller 13B and a protrusion 13C of a corresponding first conveying roller 13A is, for example, 5.8 mm.

Each protrusion 13C has a flange shape and protrudes radially beyond a circumference of a corresponding one of the first conveying rollers 13A, which have a generally solid or hollow cylindrical shape. Each protrusion 13C has an outside dimension that is larger than an outside dimension of the other portion of the first conveying roller 13A.

Figure 5A:
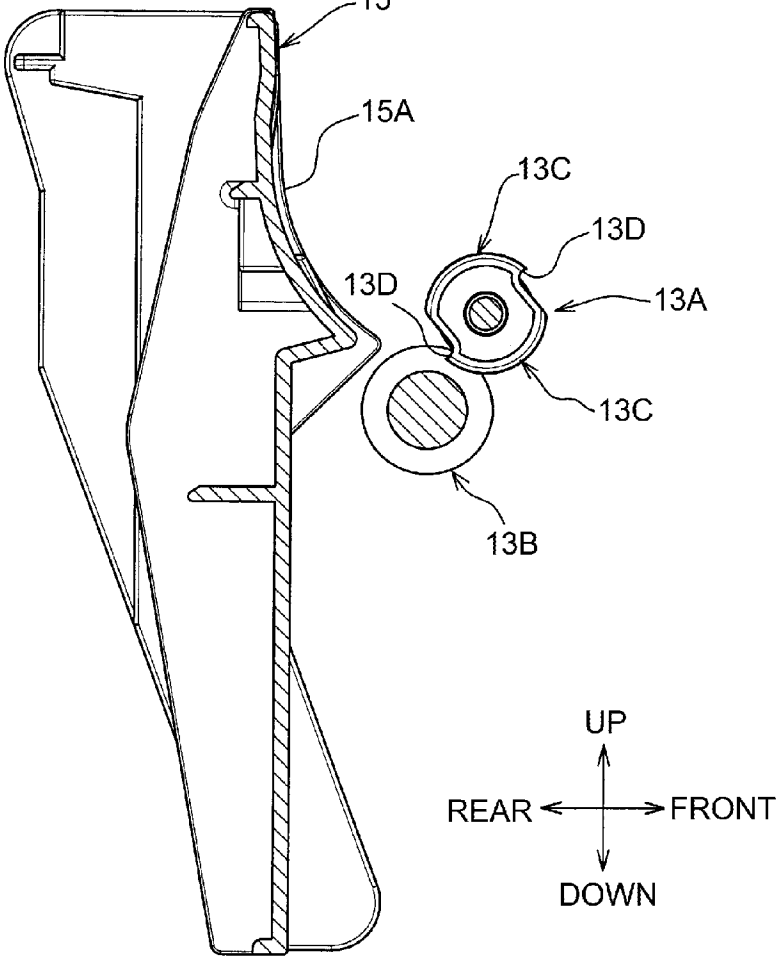
FIG. 5A is a side view depicting the first guide member and one of the conveying roller pairs in the first illustrative embodiment according to one or more aspects of the disclosure.
Figure 5B:
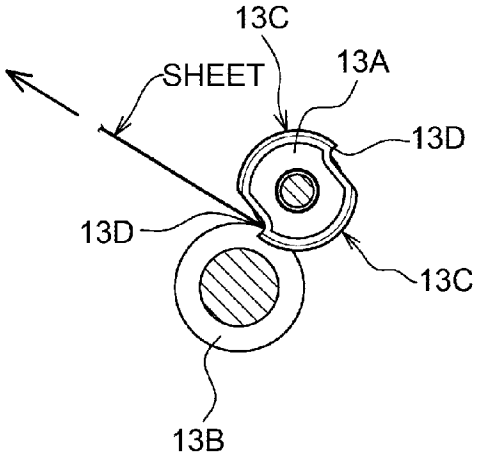
FIG. 5B is a diagram for explaining a manner of pushing a sheet in the first illustrative embodiment according to one or more aspects of the disclosure.

In the first illustrative embodiment, as depicted in FIG. 5A, each of the protrusions 13C has cutouts 13D having end portions that extend generally parallel to a diametric direction of the protrusions 13C. As depicted in FIG. 5B, the cutouts 13D apply force to a sheet to cause the sheet to move in the conveying direction while catching a trailing edge of the sheet being conveyed in the conveying direction.

In the first illustrative embodiment, all of the first conveying rollers 13A include the protrusions 13C, respectively. The protrusions 13C are all identical in shape and size. Each protrusion 13C is disposed at one of ends of the corresponding first conveying roller 13A in the axial direction.

In the first illustrative embodiment, for example, four first conveying rollers 13A are arranged along the axial direction. Each first conveying roller 13A includes the protrusion 13C at one of its ends in the axial direction. The four first conveying rollers 13A are grouped into two groups of two. Each group includes a first conveying roller 13A including the protrusion 13C at its left end in the axial direction and a first conveying roller 13A including the protrusion 13C at its right end in the axial direction.

The second conveying roller 13B includes the plurality of rollers 13E and a drive shaft 13F. The plurality of rollers 13E comes into contact with a sheet when the sheet passes the conveying roller pairs 13. The drive shaft 13F applies driving force to the rollers 13E while supporting the rollers 13E. A gear 13G is disposed at one end portion of the drive shaft 13F. Driving force from an electric motor (not depicted) is transmitted to the gear 13G.

The rollers 13E are disposed along the drive shaft 13F. In each of the rollers 13E, at least a portion that comes into contact with a sheet is made of rubber. In the first illustrative embodiment, the rollers 13E each have a diameter of, for example, 13 mm.

Each roller 13E is disposed facing a portion of the corresponding first conveying roller 13A other than the protrusion 13C of the corresponding first conveying roller 13A. In a state where there is no sheet between the rollers 13E and the first conveying rollers 13A, the rollers 13E are in contact with cylindrical surfaces of the opposing first conveying rollers 13A, respectively.

At the time of pushing a sheet by the cutouts 13D, the conveying roller pairs 13 are not in contact with the sheet and the rollers 13E are in contact with the cylindrical surfaces of the first conveying rollers 13A, respectively. That is, at the time of pushing a sheet by the cutouts 13D, the first conveying rollers 13A rotate in response to driving force from the rollers 13E, respectively.

In each of the first conveying rollers 13A, at least a portion that comes into contact with a sheet is made of resin (e.g., polyacetal resin ("POM")). The resin used for the first conveying rollers 13A has a frictional coefficient lower than resin, e.g., rubber, used for the rollers 13E of the second conveying roller 13B. In the first illustrative embodiment, in each of the first conveying rollers 13A, a cylindrical portion that comes into contact with a sheet and the protrusion 13C are integrally made of the same resin.

Figure 6:
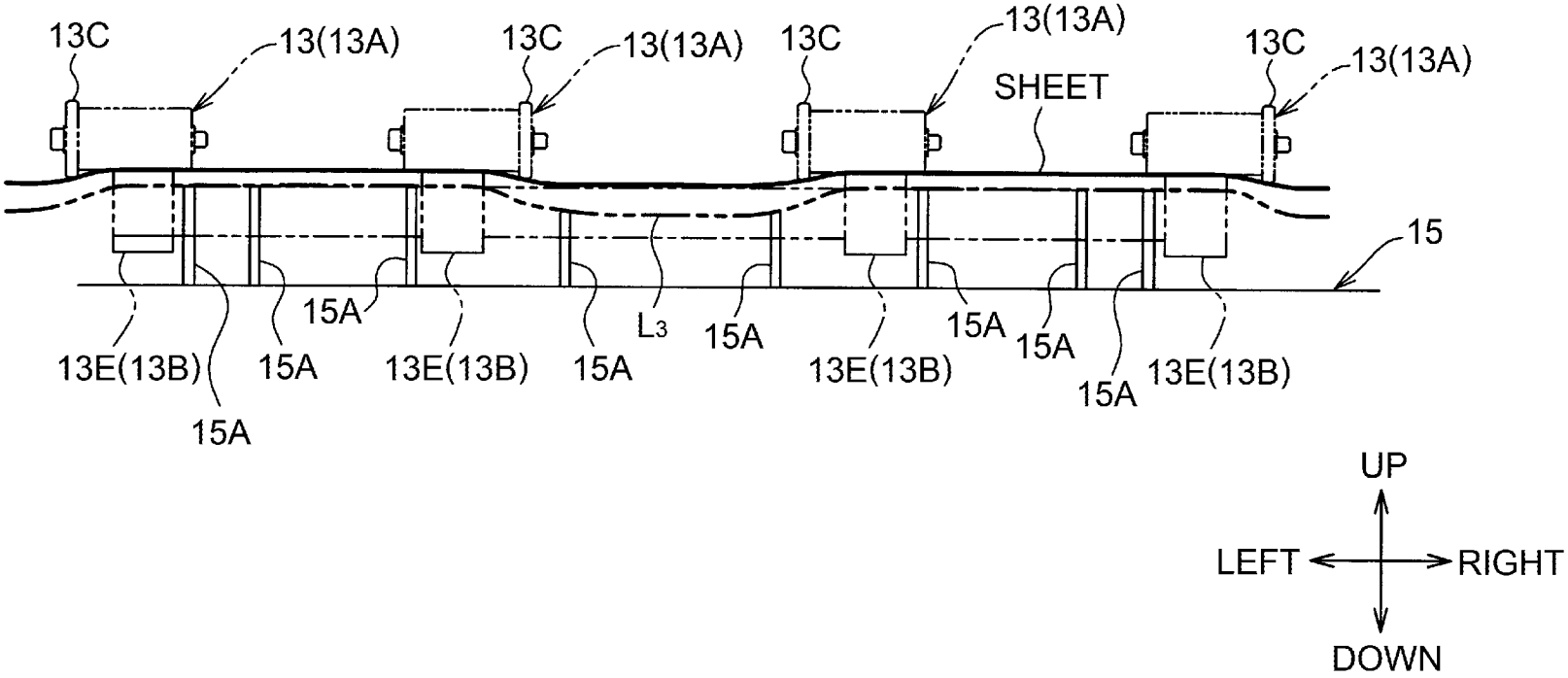
FIG. 6 is a diagram depicting a positional relationship between ribs of the first guide member and the conveying roller pairs in the first illustrative embodiment according to one or more aspects of the disclosure.
Figure 7:
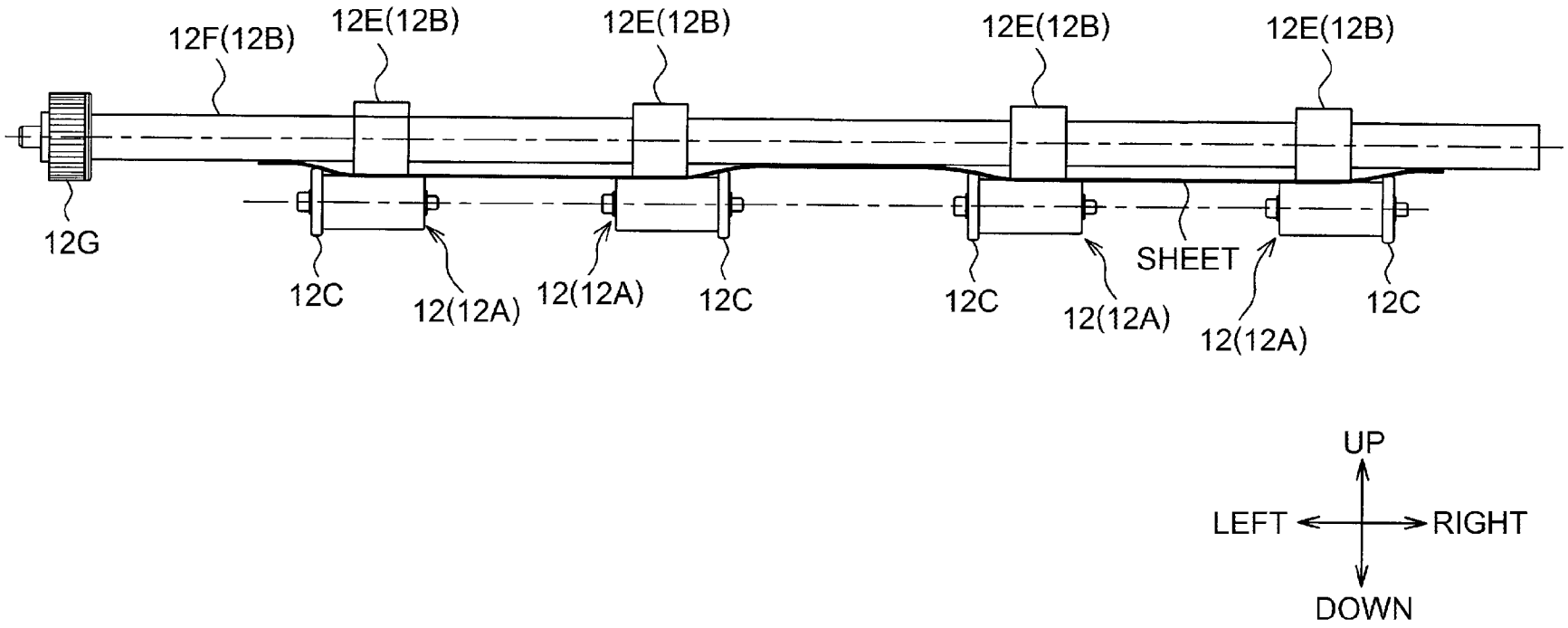
FIG. 7 is a front view depicting discharge roller pairs in the first illustrative embodiment according to one or more aspects of the disclosure.

As depicted in FIG. 5A, the first guide member 15 includes a plurality of ribs 15A. The ribs 15A are disposed downstream of the conveying roller pairs 13 in the conveying direction. The ribs 15A protrude from a surface of the first guide member 15 while extending along the sheet conveying direction. The surface from which the ribs 15A protrude faces a surface of a sheet when the sheet passes the first guide member 15. As depicted in FIG. 6, the ribs 15A have appropriate heights, respectively, such that an imaginary line L3 passing distal ends of the ribs 15A extends along groove portions and ridge portions formed in a sheet.

As described above, the imaginary line L3 extends along at least one of a groove portion and a ridge portion formed in a sheet (hereinafter, referred to as a corrugated pattern or a corrugated shape). In other words, a corrugated pattern formed in a sheet are in phase with a corrugated pattern of the imaginary line L3.

That is, the corrugated pattern of the imaginary line L3 does not counteract the corrugated pattern formed in the sheet. More specifically, for example, in a state where a sheet has a ridge portion protruding toward proximal ends of the ribs 15A, a portion of the imaginary line L3 corresponding to the ridge portion of the sheet also protrudes toward the proximal ends of the ribs 15A.

2.2 Discharge Roller Pairs

In the first illustrative embodiment, the discharge roller pairs 12 have similar configuration to the conveying roller pairs 13. That is, a plurality of first discharge rollers 12A is disposed on the same side as the heating member 11A with respect to a sheet being conveyed. A second discharge roller 12B is disposed on the same side as the pressing member 11A with respect to a sheet being conveyed. The plurality of first discharge rollers 12A forms a sheet into a corrugated shape. The second discharge roller 12B applies conveying force to the sheet.

The first discharge rollers 12A include protrusions 12C, respectively. The second discharge roller 12B includes a plurality of rollers 12E and a drive shaft 12F. The rollers 12E are made of, for example, rubber. The plurality of discharge roller pairs 12 forms a sheet into a corrugated shape such that the corrugated pattern of the sheet formed by the discharge roller pairs 12 is in phase with the corrugated pattern of the sheet formed by the conveying roller pairs 13 without counteracting the corrugated pattern of the sheet formed by the conveying roller pairs 13.

As depicted in FIG. 1, the second guide member 16 also includes a plurality of ribs 16A. An imaginary line passing distal ends of the ribs 16A extends along groove portions and ridge portions formed in a sheet by the discharge roller pairs 12. The ribs 16A are disposed upstream of the discharge roller pairs 12 in the conveying direction.

3. Features of Image Forming Apparatus according to First Illustrative Embodiment In the first illustrative embodiment, a sheet discharged from the fixing unit 11 is formed into a corrugated shape including at least one of a ridge portion and a groove portion in the sheet thickness direction before the sheet reaches the discharge roller pairs 12. Thus, stiffness of the sheet is increased, thereby preventing or reducing excessive warping of the sheet.

The force for forming a sheet into a corrugated shape acts on a sheet as a force exerted in a direction for correcting warping of the sheet, thereby preventing or reducing excessive warping of the sheet.

Accordingly, in the first illustrative embodiment, even when a sheet is warped due to heat application, the above-described configuration may prevent or reduce an occurrence of a conveyance failure.

In the first illustrative embodiment, the plurality of discharge roller pairs 12 is located at the different position from the fixing unit 11 in the up-down direction and the conveying path L1 has a U-shape. The plurality of conveying roller pairs 13 is disposed closer to the fixing unit 11 than the inflection point P1 of the conveying path L1.

Therefore, this configuration may prevent or reduce entry of a sheet into the inflection point P1 of the conveying path L1 while the sheet is excessively warped. The inflection point P1 of the conveying path L1 is the point at which the conveying direction of a sheet being conveyed is greatly changed. In the first illustrative embodiment, the warping of the sheet may be corrected before the sheet reaches the inflection point P1, thereby preventing or reducing an occurrence of a sheet conveyance failure.

In the first illustrative embodiment, in each of the rollers 13E of the second conveying roller 13B, at least a portion that comes into contact with a sheet is made of rubber. In the conveying roller pairs 13, the rollers 13E of the second conveying roller 13B are disposed on the same side as the pressing member 11B with respect to the sheet being conveyed.

This configuration may prevent or reduce undesirable adhesion of a developing agent transferred onto a sheet to the rubber rollers 13E. Therefore, this configuration may prevent or reduce an occurrence of a problem that a developing agent adheres to the rubber rollers 13E and the developing agent adhering to the rollers 13E further adheres to a sheet undesirably.

In the first illustrative embodiment, the imaginary line L3 passing the distal ends of the ribs 15A extends along at least one of a groove portion and a ridge portion formed in a sheet. This configuration may reduce frictional resistance generated between a sheet and the first guide member 15 when a sheet formed in a corrugated shape slides over the first guide member 15. Thus, this configuration may enable a smooth conveyance of a sheet.

In the first illustrative embodiment, among the first conveying rollers 13A, at least the two first conveying rollers 13A disposed at positions corresponding to end portions of a sheet in the sheet width direction include the protrusions 13C, respectively.

With this configuration, a sheet may be formed into a corrugated shape in which at least the end portions of the sheet in the width direction are depressed. Therefore, the stiffness of the sheet may be increased, thereby preventing or reducing an occurrence of dog ears. Accordingly, this configuration may prevent or reduce an occurrence of a sheet conveyance failure.

(Second Illustrative Embodiment)

Figure 8:
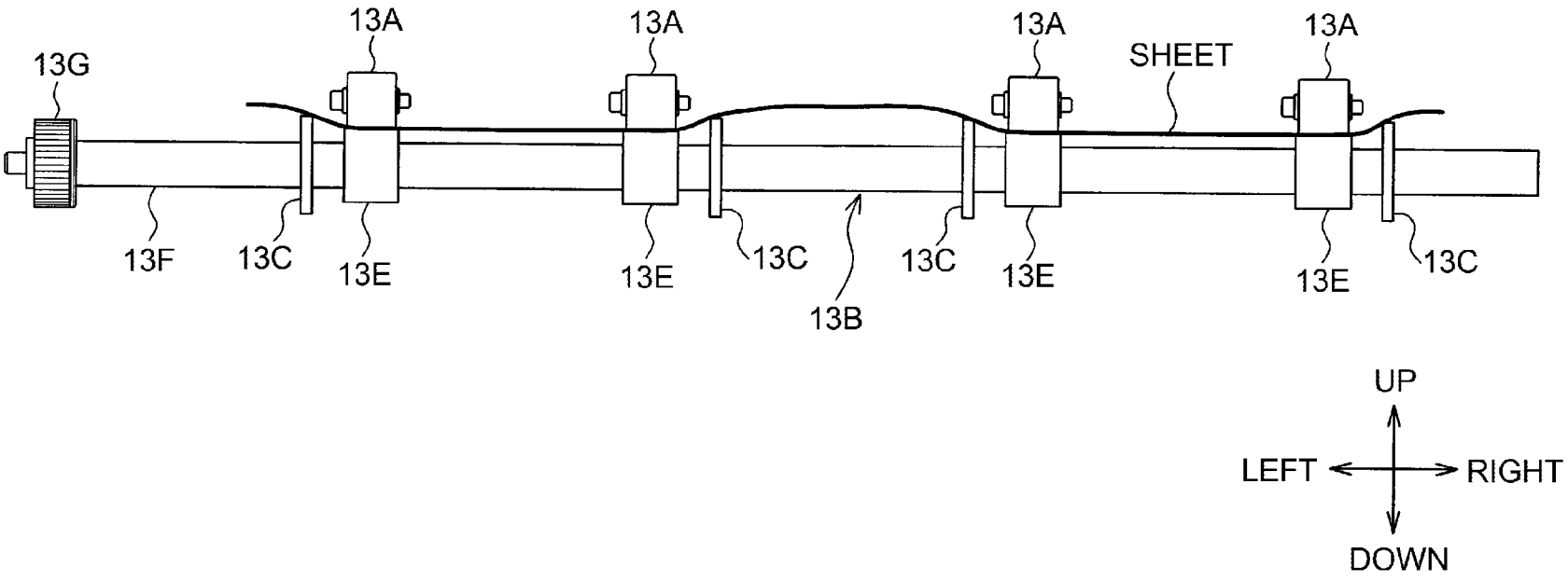
FIG. 8 is a front view depicting conveying roller pairs in a second illustrative embodiment according to one or more aspects of the disclosure.

In the first illustrative embodiment, the first conveying rollers 13A include the protrusions 13C, respectively. In contrast, in a second illustrative embodiment, for example, as depicted in FIG. 8, the protrusions 13C are disposed at the drive shaft 13F of the second conveying roller 13B. Each protrusion 13C has a flange shape and protrudes radially from the drive shaft 13F. The protrusions 13C and the drive shaft 13F are integrally made of resin. The rollers 13E are made of, for example, rubber. The first conveying rollers 13A are made of, for example, resin that is the same as the resin used for the first conveying rollers 13A in the first illustrative embodiment.

(Third Illustrative Embodiment)

Figure 9:
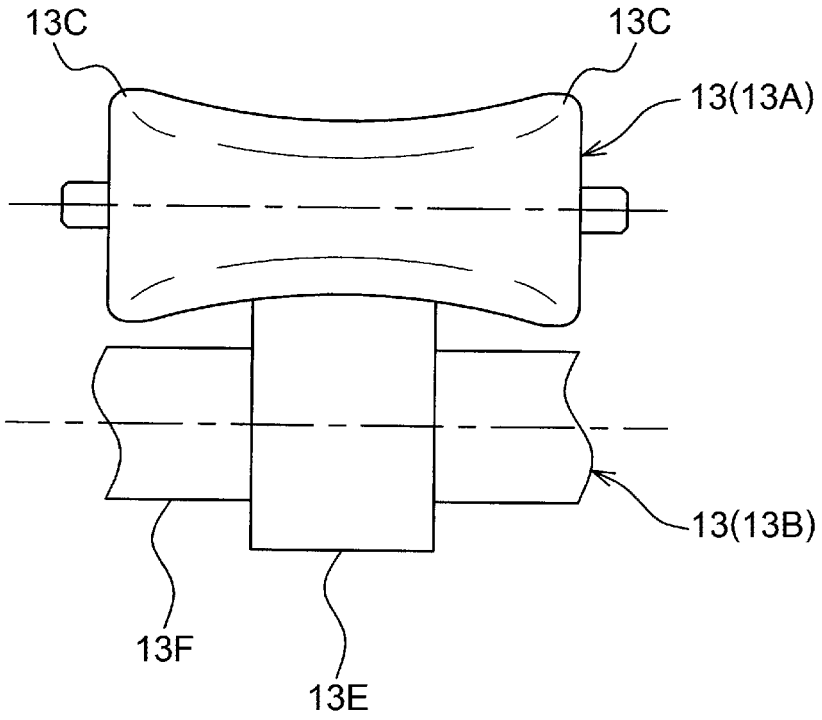
FIG. 9 is a front view depicting a conveying roller pair in a third illustrative embodiment according to one or more aspects of the disclosure.

In a third illustrative embodiment, as depicted in FIG. 9, a first conveying roller 13A has a sandglass-like shape in which the protrusions 13C are connected by a curved surface. The first conveying roller 13A, including the protrusions 13C, is integrally and entirely made of the same resin as that for the first conveying rollers 13A in the first illustrative embodiment. The rollers 13E of the second conveying roller 13B are made of rubber.

(Other Embodiments)

In the above-described illustrative embodiments, the monochrome image forming apparatus is used. Nevertheless, in other embodiments, for example, a color image forming apparatus may be used. The image forming apparatus may be of a direct transfer type or an intermediate transfer type.

In the above-described illustrative embodiments, the protrusions 13C are disposed at the respective first conveying rollers 13A or the drive shaft 13F of the second conveying roller 13B in order to form a sheet into a corrugated shape. Nevertheless, in other embodiments, for example, a roller elongated in the sheet width direction and having a corrugated pattern on its peripheral surface may be used instead of the plurality of first conveying rollers 13A including the protrusions 13C or the drive shaft 13F including the protrusions 13C.

In the above-described illustrative embodiments, the protrusions 13C for forming a sheet into a corrugated shape are disposed at the respective positions corresponding to at least the two end portions of the sheet in the width direction. Nevertheless, in other embodiments, for example, the protrusion 13C may be disposed at a particular position corresponding to a generally middle portion of a sheet in the sheet width direction.

In the above-described illustrative embodiments, the rollers 13E of the second conveying roller 13B are disposed on the same side as the pressing member 11B with respect to a sheet being conveyed and the portions of the rollers 13E that come into contact with a sheet are made of rubber. The first conveying rollers 13A are disposed on the same side as the heating member 11A with respect to a sheet being conveyed and the portions of the first conveying rollers 13A that come into contact with a sheet are made of resin. The resin used for the first conveying rollers 13A has a frictional coefficient lower than the rubber used for the rollers 13E. Nevertheless, the disclosure is not limited to the particular illustrative embodiments.

In the above-described illustrative embodiments, the image forming apparatus 1 includes the U-shaped conveying path L1. Nevertheless, the disclosure is not limited to the particular illustrative embodiments.

In the above-described illustrative embodiments, the image forming apparatus 1 is capable of straightly discharging a sheet discharged from the fixing unit 11 without changing the conveying direction of the sheet discharged from the fixing unit 11. Nevertheless, the disclosure is not limited to the particular illustrative embodiments.

In the above-described illustrative embodiments, the imaginary line L3 passing distal ends of the ribs 15A disposed at the first guide member 15 extends along the corrugated shape formed in a sheet. Nevertheless, the disclosure is not limited to the particular illustrative embodiments.

Although the disclosure has been described based on illustrative embodiments and variations, the illustrative embodiments of the disclosure facilitate the understanding of the disclosure and do not limit the disclosure. The disclosure may be changed or modified without departing from the spirit of the invention and the scope of the claims and includes the equivalents thereof.

What is claimed is:

1. An image forming apparatus comprising:

a transfer unit configured to transfer a developing agent image onto a sheet;

a fixing unit comprising a heating member configured to thermally fix the developing agent image onto the sheet, and a pressing member configured to press the sheet against the heating member;

a discharge tray configured to receive the sheet having the developing agent image fixed thereon;

at least one pair of switchback rollers disposed upstream of the discharge tray in a conveying direction, the at least one pair of switchback rollers being configured to discharge the sheet having the developing agent image fixed thereon in the conveying direction toward the discharge tray and then switch back the sheet toward the transfer unit along a return path in a direction reverse to the conveying direction; and a corrugation system disposed away from the return path and at a conveying path extending between the fixing unit and the at least one pair of switchback rollers, the corrugation system including at least one pair of conveying rollers configured to convey the sheet passing out of the fixing unit toward the at least one pair of switchback rollers along the conveying path in the conveying direction and to form the sheet passing out of the fixing unit into a corrugated shape having at least one of a ridge portion and a groove portion in a sheet thickness direction, wherein the at least one pair of conveying rollers includes a first pair of conveying rollers and the corrugation system further includes a shaft that supports one roller of the first pair of conveying rollers, the shaft including a protrusion configured to contact an end portion, in a sheet width direction, of the sheet passing out of the fixing unit and to form the sheet passing out of the fixing unit into the corrugated shape, the sheet width direction being perpendicular to the conveying direction, and wherein the protrusion has a flange shape and protrudes radially from the shaft of the corrugation system.

2. The image forming apparatus according to claim 1, wherein the one roller of the first pair of conveying rollers and the pressing member are positioned on a same side of the conveying path.

3. The image forming apparatus according to claim 1, wherein the at least one pair of switchback rollers is vertically spaced from the fixing unit, the conveying path being curved in a U-shape, and the at least one pair of conveying rollers of the corrugation system is downstream of the fixing unit and upstream of an inflection point of the conveying path in the conveying direction.

4. The image forming apparatus according to claim 1, wherein the at least one pair of conveying rollers of the corrugation system includes a conveying roller including a rubber portion configured to contact the sheet passing out of the fixing unit, and a conveying roller including a resin portion configured to contact the sheet passing out of the fixing unit, the resin portion having a lower frictional force than the rubber portion.

5. The image forming apparatus according to claim 4, wherein the pressing member and the conveying roller having the rubber portion are positioned on a same side of the conveying path.

6. The image forming apparatus according to claim 1, further comprising a guide member configured to define a part of the conveying path and guide the sheet, the guide member including a plurality of ribs projecting toward the sheet passing out of the fixing unit and extending in the conveying direction, and an imaginary line connecting distal ends of the plurality of ribs extending along the corrugated shape formed in the sheet.

7. The image forming apparatus according to claim 1, wherein the at least one pair of switchback rollers is configured to form the sheet having the developing agent image fixed thereon into a corrugated shape having at least one of a ridge portion and a groove portion in the sheet thickness direction.

8. The image forming apparatus according to claim 1, wherein the conveying path is branched into the return path at a position downstream of the at least one pair of conveying rollers and upstream of the at least one pair of switchback rollers in the conveying direction.

9. The image forming apparatus according to claim 1, further comprising a housing and a guide member configured to pivot, relative to the housing, about a lower end portion thereof between a first position and a second position, the guide member when in the first position defining a part of the conveying path, and the guide member when in the second position exposing the conveying path and guiding the sheet conveyed from the fixing unit toward an exterior of the housing.

10. An image forming apparatus comprising:

a transfer unit configured to transfer a developing agent image onto a sheet;

a fixing unit comprising a heating member configured to thermally fix the developing agent image onto the sheet, and a pressing member configured to press the sheet against the heating member;

a discharge tray configured to receive the sheet having the developing agent image fixed thereon;

at least one pair of discharge rollers disposed upstream of the discharge tray in a conveying direction and configured to discharge the sheet having the image fixed thereon toward the discharge tray; and a corrugation system disposed at a conveying path extending between the fixing unit and the at least one pair of discharge rollers, the corrugation system including at least one pair of conveying rollers configured to convey the sheet passing out of the fixing unit toward the at least one pair of discharge rollers along the conveying path in the conveying direction and to form the sheet passing out of the fixing unit into a corrugated shape having at least one of a ridge portion and a groove portion in a sheet thickness direction, wherein the at least one pair of conveying rollers of the corrugation system includes a rubber driving roller and a resin driven roller having a lower frictional force than the rubber driving roller, and the resin driven roller of the corrugation system and the heating member of the fixing unit are positioned on a same side of the conveying path, and wherein the corrugation system further includes a resin shaft that supports the rubber driving roller, the resin shaft including a resin protrusion configured to contact an end portion, in a sheet width direction, of the sheet passing out of the fixing unit and to form the sheet passing out of the fixing unit into the corrugated shape, the sheet width direction being perpendicular to the conveying direction.

11. The image forming apparatus according to claim 10, wherein the fixing unit supports the resin driven roller of the corrugation system.

12. The image forming apparatus according to claim 10, wherein the rubber driving roller of the corrugation system and the pressing member of the fixing unit are positioned on a same side of the conveying path.

* * * * *